US007843398B1

(12) United States Patent
Horner

(10) Patent No.: US 7,843,398 B1
(45) Date of Patent: Nov. 30, 2010

(54) TAPERED SLOT ANTENNA EC METHOD

(75) Inventor: Robert Horner, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/623,830

(22) Filed: Nov. 23, 2009

Related U.S. Application Data

(63) Continuation of application No. 11/775,036, filed on Jul. 9, 2007, now Pat. No. 7,679,574, which is a continuation-in-part of application No. 11/645,261, filed on Nov. 28, 2006, now Pat. No. 7,358,914.

(51) Int. Cl.
*H01Q 13/00* (2006.01)

(52) U.S. Cl. ..... 343/767; 343/770

(58) Field of Classification Search ..... 343/767, 343/768, 769, 770
See application file for complete search history.

(56) References Cited

U.S. PATENT DOCUMENTS

| | | | | |
|---|---|---|---|---|
| 2,996,715 | A * | 8/1961 | Rumsey et al. | 343/767 |
| 5,185,611 | A * | 2/1993 | Bitter, Jr. | 343/702 |
| 5,461,392 | A * | 10/1995 | Mott et al. | 343/725 |
| 5,786,792 | A * | 7/1998 | Bellus et al. | 343/770 |
| 6,842,154 | B1 * | 1/2005 | Apostolos | 343/767 |
| 6,850,203 | B1 * | 2/2005 | Schuneman et al. | 343/767 |

* cited by examiner

*Primary Examiner*—Tho G Phan
(74) *Attorney, Agent, or Firm*—Kyle Eppele; Stephen E. Baldwin

(57) ABSTRACT

The method comprising coupling a first antenna element to a second antenna element to for a tapered slot antenna pair; electrically coupling a first end cap to the first antenna element; electrically couples a second end cap to the second antenna element; and configuring the first and second end caps to provide induction-canceling, capacitive coupling when operating at frequencies below a theoretical cutoff frequency.

4 Claims, 9 Drawing Sheets

Front View
100
130
110
194
120
114
124
132
Z
Y
X

Side View
100
140
K
L
N
146
142
116
110
130
114
112
194
122
126
120
124
132
144
M
Z
Y
X Top View Top View Top View

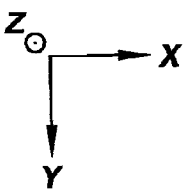
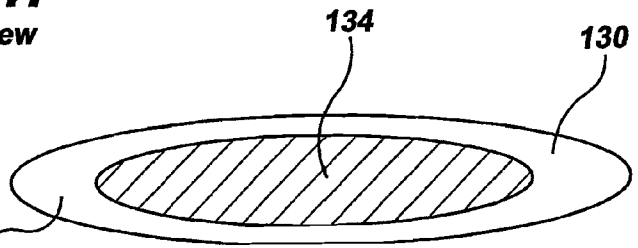
FIG.1F
Top View
100
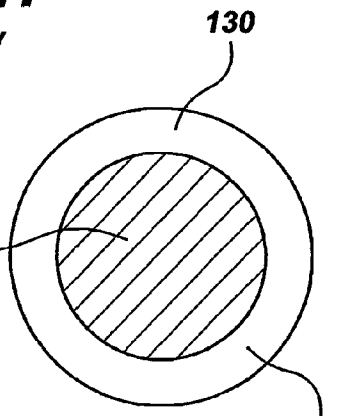
FIG.1H
Top View
100
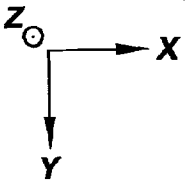
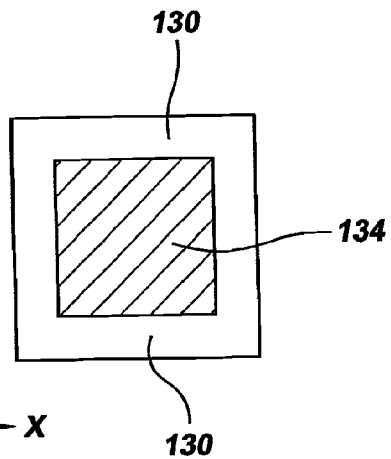
FIG.1G
Top View
100
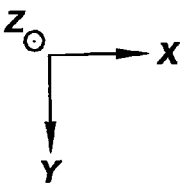

Front View

Front View

Front View

Front View

Front View

Front View (Note: FIGS 2A-2B are NOT drawn to scale relative to each other)

Top View (Note: FIGS 2A-2B are NOT drawn to scale relative to each other)

TAPERED SLOT ANTENNA EC METHOD

CROSS-REFERENCE TO RELATED APPLICATIONS

This application is a continuation of U.S. Ser. No. 11/775,036, filed Jul. 9, 2007, now U.S. Pat. No. 7,679,574, issued Mar. 16, 2010, entitled Tapered Slot Antenna EC Method, which is a continuation-in-part of U.S. Ser. No. 11/645,261, entitled "Tapered Slot Antenna End Caps," by HORNER et al. filed Nov. 28, 2006, now U.S. Pat. No. 7,358,914, issued on Apr. 15, 2008, which is hereby incorporated by reference herein in its entirety for its teachings and is hereinafter referred to as the "parent application." (NC#098103). This application is related to U.S. Pat. No. 7,009,572, issued on Mar. 7, 2006, entitled "Tapered Slot Antenna", by Rob HORNER et al., Navy Case No. 96507, which is hereby incorporated by reference in its entirety herein for its teachings on antennas. This application is also related to U.S. Ser. No. 11/472,514 filed on Jun. 15, 2006, now U.S. Pat. No. 7,518,565, issued on Apr. 14, 2009, entitled "Tapered Slot Antenna Cylindrical Array", by Rob HORNER et al., Navy Case No. 97194, which is hereby incorporated by reference in its entirety herein for its teachings on antennas. This application is also related to U.S. Ser. No. 11/482,301 filed on Jun. 27, 2006, entitled "Tapered Slot Antenna Cylindrical Array", by Rob HORNER et al., Navy Case No. 98219, which is hereby incorporated by reference in its entirety herein for its teachings on antennas.

FEDERALLY SPONSORED RESEARCH AND DEVELOPMENT

This invention (Navy Case No. 098517) is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case Number 098517.

BACKGROUND OF THE INVENTION

The present invention is generally in the field of antennas.

Typical tapered slot antennas suffer from a greatly decreased gain and sensitivity when operating at frequencies below the theoretical cutoff frequency.

A need exists for a tapered slot antenna that does not suffer from a greatly decreased gain and sensitivity when operating at frequencies below the theoretical cutoff frequency.

BRIEF DESCRIPTION OF THE DRAWINGS

All FIGURES are not drawn to scale.

FIG. 1F is a top view of one embodiment of a TSAEC apparatus.

FIG. 1G is a top view of one embodiment of a TSAEC apparatus.

FIG. 1H is a top view of one embodiment of a TSAEC apparatus.

DETAILED DESCRIPTION OF THE INVENTION

Described herein is Tapered Slot Antenna EC Method.

DEFINITIONS

The following acronyms are used herein:

Acronym(s):

AE—Antenna Element(s)

EC—End Caps

RF—radio frequency

TSA—Tapered Slot Antenna(s)

TSAEC—Tapered Slot Antenna End Cap(s)

Definition(s):

Feed End—Portion of a TSA from which an input signal is received

Launch End—Portion of a TSA distal to the feed end

Lowest Operating Frequency—theoretical cutoff frequency for a TSA having specific dimensions Theoretical Cutoff Frequency—a frequency at which an antenna's largest dimension (or antenna height) is greater than or equal to half of the respective wavelength The tapered slot antenna end cap (TSAEC) apparatus includes at least one tapered slot antenna (TSA). The at least one TSA of the TSAEC apparatus includes two antenna elements (AE) having a TSA configuration and two end caps (EC). An EC is electrically coupled to each AE to provide capacitive coupling when operating with frequencies lower than a LOF for a TSA, which counteracts inductance created by low frequency RF energy. Thus, a greater antenna sensitivity is achieved when operating below a theoretical cutoff frequency. In one embodiment, the TSAEC apparatus comprises a rectangular plate configuration. In one embodiment, the TSAEC apparatus comprises an oval plate configuration. In one embodiment, the TSAEC apparatus comprises a hollow rectangular plate configuration. In one embodiment, the TSAEC apparatus comprises a hollow oval plate configuration. In one embodiment, the TSAEC apparatus comprises a hollow square plate configuration. In one embodiment, the TSAEC apparatus comprises a square plate configuration. In one embodiment, the TSAEC apparatus comprises a circular plate configuration. In one embodiment, the TSAEC apparatus comprises a hollow circular plate configuration. In one embodiment, the TSAEC apparatus comprises a single plate configuration. In one embodiment, the TSAEC apparatus comprises a stacked plate configuration. In one embodiment, the TSAEC apparatus comprises a folded plate configuration. In one embodiment, the TSAEC apparatus comprises a stacked folded plate configuration. In one embodiment, the TSAEC apparatus comprises a curved plate configuration. In one embodiment, the TSAEC apparatus comprises a stacked curved plate configuration. In one embodiment, the TSAEC apparatus comprises a copper mesh enclosed configuration. In one embodiment, the TSAEC apparatus comprises a radome enclosed configuration. In one embodiment, the TSAEC apparatus comprises a cylindrical array.

Figures 1A, 1B:
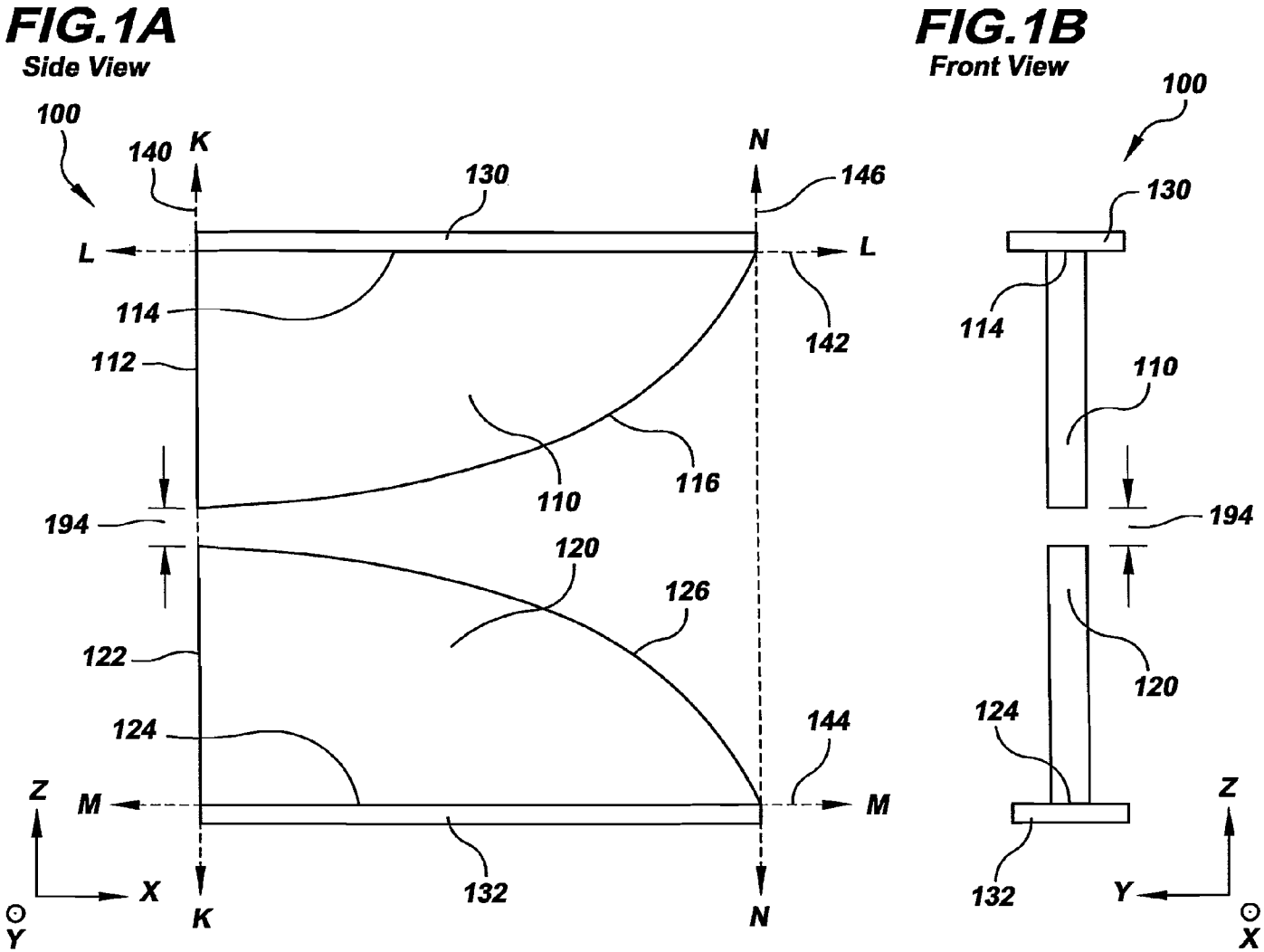
FIG. 1A is a side view of one embodiment of a TSAEC apparatus.
FIG. 1B is a front view of one embodiment of a TSAEC apparatus.

FIG. 1A is a side view of one embodiment of a tapered slot antenna end cap apparatus. As shown in FIG. 1A, TSAEC apparatus 100 includes first end cap 130, second end cap 132 and a tapered slot antenna pair (comprising first antenna element 110, second antenna element 120). TSAEC apparatus 100 of FIG. 1A is also referred to as a single plate configuration because first and second end caps 130, 132 form single plates on first and second antenna elements 110, 120. First antenna element 110 and second antenna element 120 comprise a substantially conductive material such as, for example, stainless steel and aluminum. As shown in FIG. 1A, first antenna element 110 and second antenna element 120 are situated in a tapered slot antenna pair configuration. First antenna element 110 has input edge 112, lateral edge 114 and curved edge 116. Lateral edge 114 corresponds to the portion of first AE 110 that is proximate to axis 142 (represented by dashed line L-L on FIG. 1A). Second antenna element 120 has input edge 122, lateral edge 124 and curved edge 126. Lateral edge 124 corresponds to the portion of second AE 120 that is proximate to axis 144 (represented by dashed line M-M on FIG. 1A).

The antenna pair of TSAEC apparatus 100 has gap height 194, a feed end and a launch end. The feed end of the antenna pair corresponds to the portion of the antenna pair that is proximate to axis 140 (represented by dashed line K-K on FIG. 1A). The feed end can also be represented by input edges 112, 122 of antenna elements 110, 120, respectively. The feed end receives and transmits signals. The launch end of the antenna pair corresponds to the portion of the antenna pair that is proximate to axis 146 (represented by dashed line N-N on FIG. 1A). Note that the launch end only denotes a location on the antenna pair versus an actual launch point of a particular frequency. The feed end can be operatively coupled to an input/output (I/O) feed such as a coaxial cable. An I/O feed can be used to transmit and receive RF signals to and from TSAEC apparatus 100. RF signals can be transmitted from the feed end toward the launch end, wherein the RF signals launch from the antenna pair at a point between the feed end and the launch end depending on the signal frequency. RF signals having higher frequencies (and are greater than the LOF) launch closer to the feed end and RF signals having lower frequencies (and are greater than the LOF) launch closer to the launch end.

In one embodiment, AE 110, 120 have curvatures that can each be represented by the following Equation 1:

$$Y(x)=a(e^{bx}-1); \quad \text{(Equation 1)}$$

where, a and b are parameters selected to produce a desired curvature. In one embodiment, parameters "a" and "b" are approximately equal to 0.2801 and 0.1028, respectively.

First end cap 130 is electrically coupled to first AE 110 to provide capacitive coupling when TSAEC apparatus 100 operates at frequencies lower than a LOF for TSAEC apparatus 100, which counteracts inductance (i.e., cancels induction) created by low frequency RF energy. In the embodiment of TSAEC apparatus 100 shown in FIG. 1A, first end cap 130 is also physically coupled to first AE 110 along lateral edge 114. Those skilled in the art shall recognize that first end cap 130 can be physically uncoupled from first AE 110 (while being electrically coupled) without departing from the scope and spirit of TSAEC apparatus (i.e., the end caps and antenna elements do not require a DC connection).

Second end cap 132 is electrically coupled to second AE 120 to provide capacitive coupling when TSAEC apparatus 100 operates at frequencies lower than a LOF for TSAEC apparatus 100, which counteracts inductance created by low frequency RF energy. In the embodiment of TSAEC apparatus 100 shown in FIG. 1A, second end cap 132 is also physically coupled to second AE 120 along lateral edge 124. Those skilled in the art shall recognize that first end cap 132 can be physically uncoupled from second AE 120 (while being electrically coupled) without departing from the scope and spirit of TSAEC apparatus.

FIG. 1B is a front view of one embodiment of a TSAEC apparatus of FIG. 1A. TSAEC apparatus 100 of FIG. 1B is substantially similar to TSAEC apparatus 100 of FIG. 1A, and thus, similar components are not described again in detail hereinbelow. TSAEC apparatus 100 of FIG. 1B depicts end caps having a rectangular plate configuration. As shown in FIG. 1B, TSAEC apparatus 100 includes an antenna pair (i.e., antenna element 110, antenna element 120) and first and second end caps 130, 132. The antenna pair of TSAEC apparatus 100 has gap height 194.

Figure 1C:
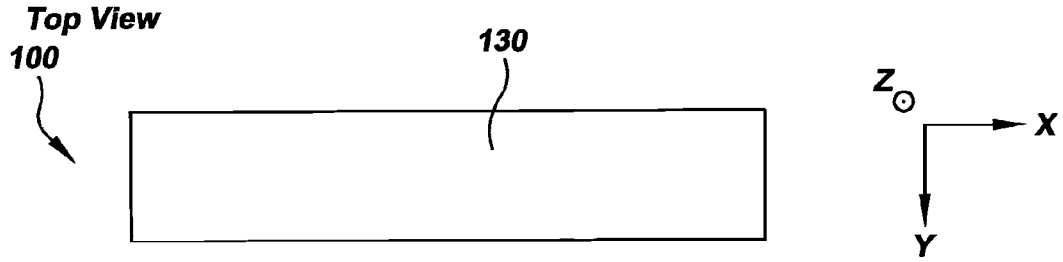
FIG. 1C is a top view of one embodiment of a TSAEC apparatus.

FIG. 1C is a top view of one embodiment of a TSAEC apparatus of FIG. 1A. TSAEC apparatus 100 of FIG. 1C is substantially similar to TSAEC apparatus 100 of FIG. 1A, and thus, similar components are not described again in detail hereinbelow. TSAEC apparatus 100 of FIG. 1C depicts end cap 130 having a rectangular plate configuration.

Figure 1D:
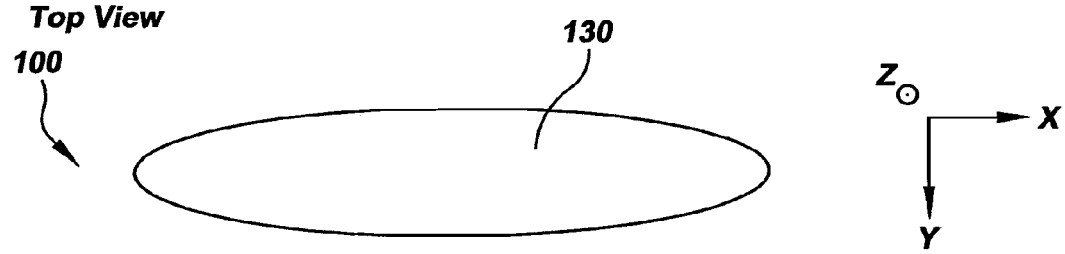
FIG. 1D is a top view of one embodiment of a TSAEC apparatus.

FIG. 1D is a top view of one embodiment of a TSAEC apparatus of FIG. 1A. TSAEC apparatus 100 of FIG. 1D is substantially similar to TSAEC apparatus 100 of FIG. 1A, and thus, similar components are not described again in detail hereinbelow. TSAEC apparatus 100 of FIG. 1D depicts end cap 130 having an oval plate configuration.

Figure 1E:
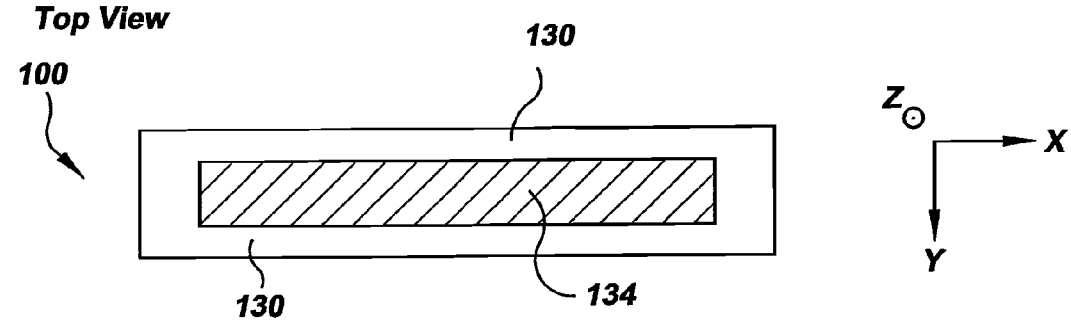
FIG. 1E is a top view of one embodiment of a TSAEC apparatus.

FIG. 1E is a top view of one embodiment of a TSAEC apparatus of FIG. 1A. TSAEC apparatus 100 of FIG. 1E is substantially similar to TSAEC apparatus 100 of FIG. 1A, and thus, similar components are not described again in detail hereinbelow. TSAEC apparatus 100 of FIG. 1E depicts end cap 130 having a hollow rectangular plate configuration. As shown in FIG. 1E, end cap 130 encloses end cap interior region 134. End cap interior region 134 comprises material different than the material comprising end cap 130. In one embodiment, end cap interior region 134 comprises air. In one embodiment, end cap interior region 134 comprises copper mesh. In one embodiment, end cap interior region 134 comprises a nonconductive material.

FIG. 1F is a top view of one embodiment of a TSAEC apparatus of FIG. 1A. TSAEC apparatus 100 of FIG. 1F is substantially similar to TSAEC apparatus 100 of FIG. 1A, and thus, similar components are not described again in detail hereinbelow. TSAEC apparatus 100 of FIG. 1F depicts end cap 130 having a hollow oval plate configuration. As shown in FIG. 1F, end cap 130 encloses end cap interior region 134. End cap interior region 134 comprises material different than the material comprising end cap 130. In one embodiment, end cap interior region 134 comprises air. In one embodiment, end cap interior region 134 comprises copper mesh. In one embodiment, end cap interior region 134 comprises a non-conductive material.

FIG. 1G is a top view of one embodiment of a TSAEC apparatus of FIG. 1A. TSAEC apparatus 100 of FIG. 1G is substantially similar to TSAEC apparatus 100 of FIG. 1A, and thus, similar components are not described again in detail hereinbelow. TSAEC apparatus 100 of FIG. 1G depicts end cap 130 having a hollow square plate configuration. As shown in FIG. 1G, end cap 130 encloses end cap interior region 134. End cap interior region 134 comprises material different than the material comprising end cap 130. In one embodiment, end cap interior region 134 comprises air. In one embodiment, end cap interior region 134 comprises copper mesh. In one embodiment, end cap interior region 134 comprises a non-conductive material. In one embodiment referred to as a square plate configuration, end cap interior region 134 comprises the same material as end cap 130.

FIG. 1H is a top view of one embodiment of a TSAEC apparatus of FIG. 1A. TSAEC apparatus 100 of FIG. 1H is substantially similar to TSAEC apparatus 100 of FIG. 1A, and thus, similar components are not described again in detail hereinbelow. TSAEC apparatus 100 of FIG. 1H depicts end cap 130 having a hollow circular plate configuration. As shown in FIG. 1H, end cap 130 encloses end cap interior region 134. End cap interior region 134 comprises material different than the material comprising end cap 130. In one embodiment, end cap interior region 134 comprises air. In one embodiment, end cap interior region 134 comprises copper mesh. In one embodiment, end cap interior region 134 comprises a nonconductive material. In one embodiment referred to as a circular plate configuration, end cap interior region 134 comprises the same material as end cap 130.

Figure 1J:
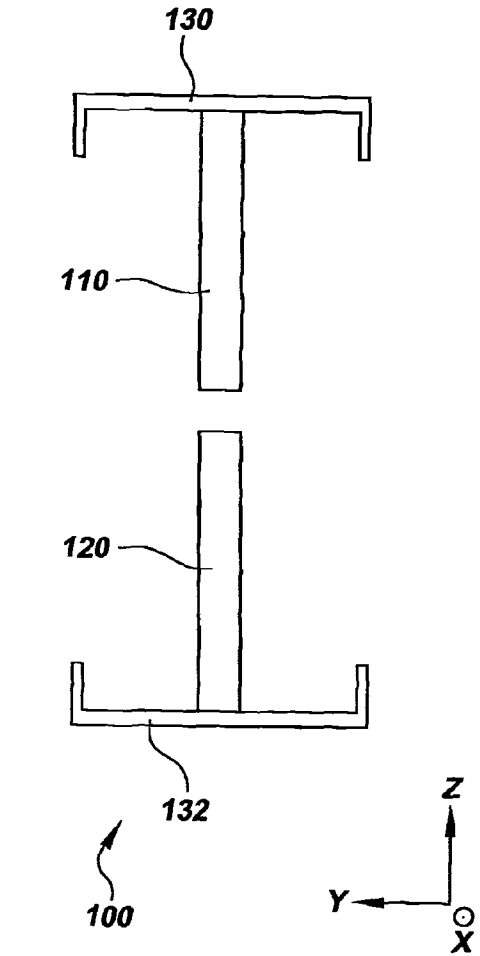
FIG. 1J is a front view of one embodiment of a TSAEC apparatus.
Figure 1I:
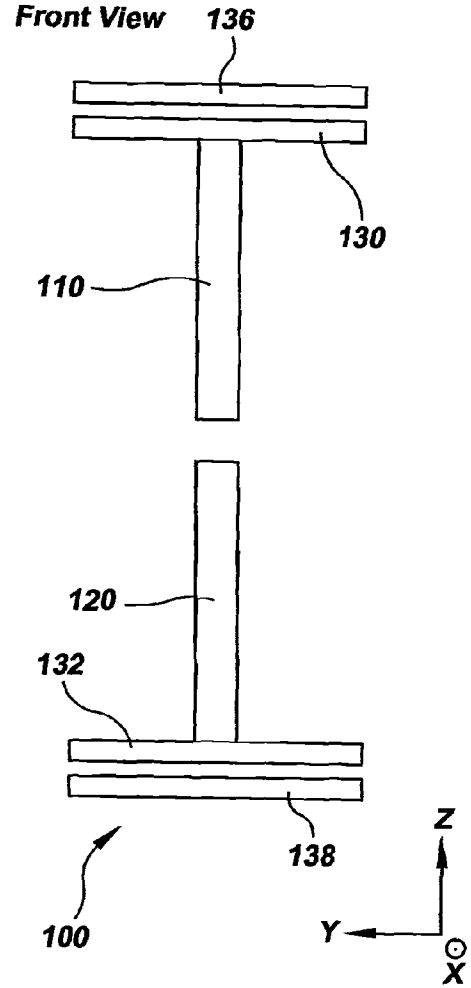
FIG. 1I is a front view of one embodiment of a TSAEC apparatus.

FIG. 1I is a front view of one embodiment of a TSAEC apparatus of FIG. 1A. TSAEC apparatus 100 of FIG. 1I is substantially similar to TSAEC apparatus 100 of FIG. 1A, and thus, similar components are not described again in detail hereinbelow. As shown in FIG. 1I, TSAEC apparatus 100 includes first end cap 130, second end cap 132, third end cap 136 and fourth end cap 138. TSAEC apparatus 100 of FIG. 1I has a stacked plate configuration because third and fourth end caps 136, 138 are stacked in relation to first and second end caps 130, 132, respectively. The stacked plate configuration provides a means of creating additional capacitive coupling.

FIG. 1J is a front view of one embodiment of a TSAEC apparatus of FIG. 1A. TSAEC apparatus 100 of FIG. 1J is substantially similar to TSAEC apparatus 100 of FIG. 1A, and thus, similar components are not described again in detail hereinbelow. As shown in FIG. 1J, TSAEC apparatus 100 includes first end cap 130 and second end cap 132. TSAEC apparatus 100 of FIG. 1J has a folded plate configuration because first and second end caps 130, 132 are folded. The folded plate configuration provides a means of creating capacitive coupling.

Figure 1L:
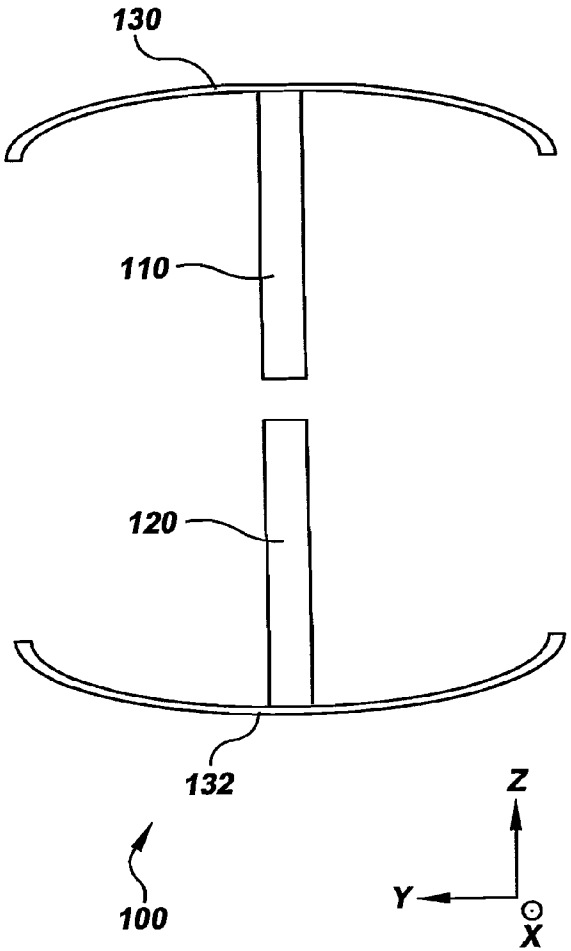
FIG. 1L is a front view of one embodiment of a TSAEC apparatus.
Figure 1K:
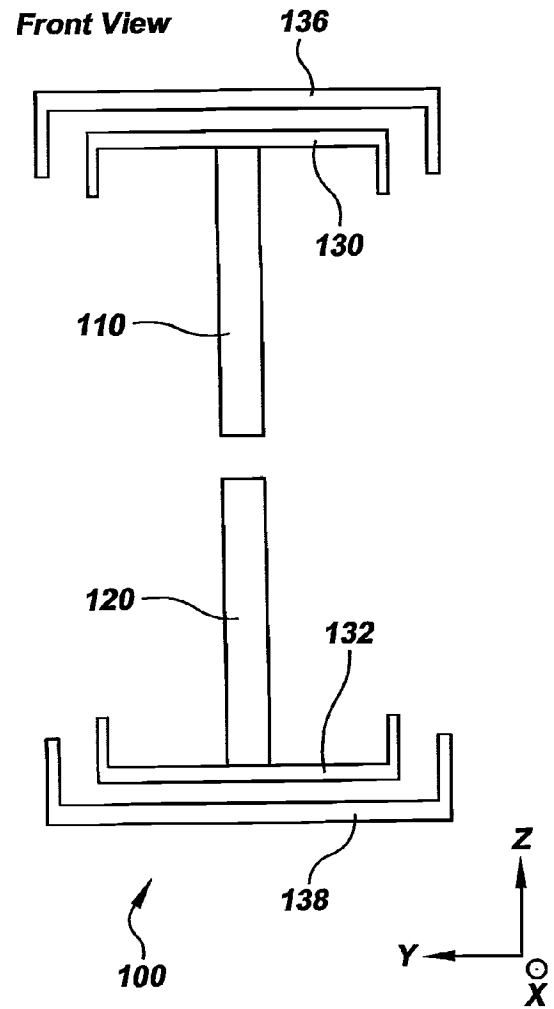
FIG. 1K is a front view of one embodiment of a TSAEC apparatus.

FIG. 1K is a front view of one embodiment of a TSAEC apparatus of FIG. 1A. TSAEC apparatus 100 of FIG. 1K is substantially similar to TSAEC apparatus 100 of FIG. 1A, and thus, similar components are not described again in detail hereinbelow. As shown in FIG. 1K, TSAEC apparatus 100 includes first end cap 130, second end cap 132, third end cap 136 and fourth end cap 138. TSAEC apparatus 100 of FIG. 1K has a stacked folded plate configuration because third and fourth end caps 136, 138 are stacked in relation to first and second end caps 130, 132, respectively and all end caps have a folded plate configuration. The stacked folded plate configuration provides a means of creating capacitive coupling.

FIG. 1L is a front view of one embodiment of a TSAEC apparatus of FIG. 1A. TSAEC apparatus 100 of FIG. 1L is substantially similar to TSAEC apparatus 100 of FIG. 1A, and thus, similar components are not described again in detail hereinbelow. As shown in FIG. 1L, TSAEC apparatus 100 includes first end cap 130 and second end cap 132. TSAEC apparatus 100 of FIG. 1L has a curved plate configuration because first and second end caps 130, 132 are curved. The curved plate configuration provides a means of creating capacitive coupling.

Figure 1N:
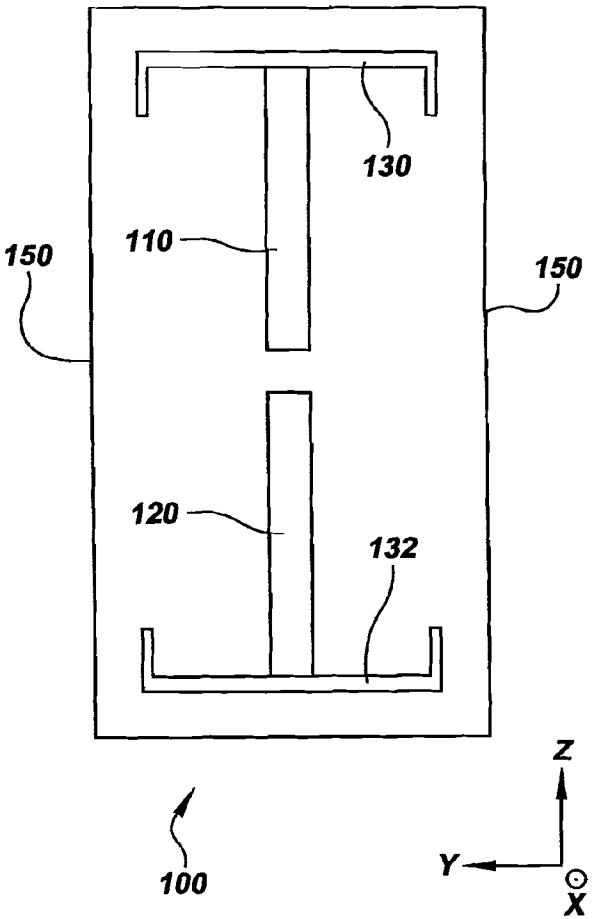
FIG. 1N is a front view of one embodiment of a TSAEC apparatus.
Figure 1M:
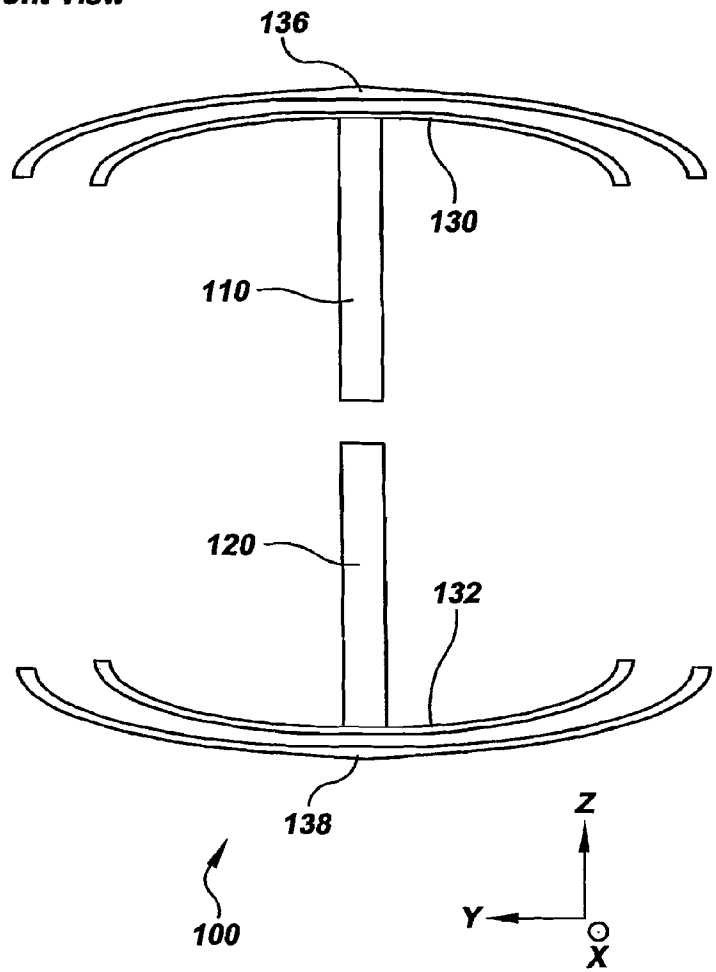
FIG. 1M is a front view of one embodiment of a TSAEC apparatus.

FIG. 1M is a front view of one embodiment of a TSAEC apparatus of FIG. 1A. TSAEC apparatus 100 of FIG. 1M is substantially similar to TSAEC apparatus 100 of FIG. 1A, and thus, similar components are not described again in detail hereinbelow. As shown in FIG. 1M, TSAEC apparatus 100 includes first end cap 130, second end cap 132, third end cap 136 and fourth end cap 138. TSAEC apparatus 100 of FIG. 1M has a stacked circular plate configuration because third and fourth end caps 136, 138 are stacked in relation to first and second end caps 130, 132, respectively and all end caps have a curved plate configuration. The stacked curved plate configuration provides a means of creating capacitive coupling.

FIG. 1N is a front view of one embodiment of a TSAEC apparatus of FIG. 1A. TSAEC apparatus 100 of FIG. 1N is substantially similar to TSAEC apparatus 100 of FIG. 1A, and thus, similar components are not described again in detail hereinbelow. As shown in FIG. 1N, TSAEC apparatus 100 includes TSAEC enclosure 150, first end cap 130 and second end cap 132. TSAEC apparatus 100 of FIG. 1N has an enclosed configuration because TSAEC enclosure 150 encloses TSAEC apparatus 100. In one embodiment, TSAEC enclosure 150 comprises copper mesh. The copper mesh embodiment provides additional capacitive coupling, which provides additional counter-inductance when operating at or below the lowest operating frequency. In one embodiment, TSAEC apparatus 100 is designed to optimize the balance between capacitance generated by the end caps and inductance created when operating at frequencies below the lowest operating frequency. In one embodiment, TSAEC enclosure 150 comprises a radome.

Figure 2A:
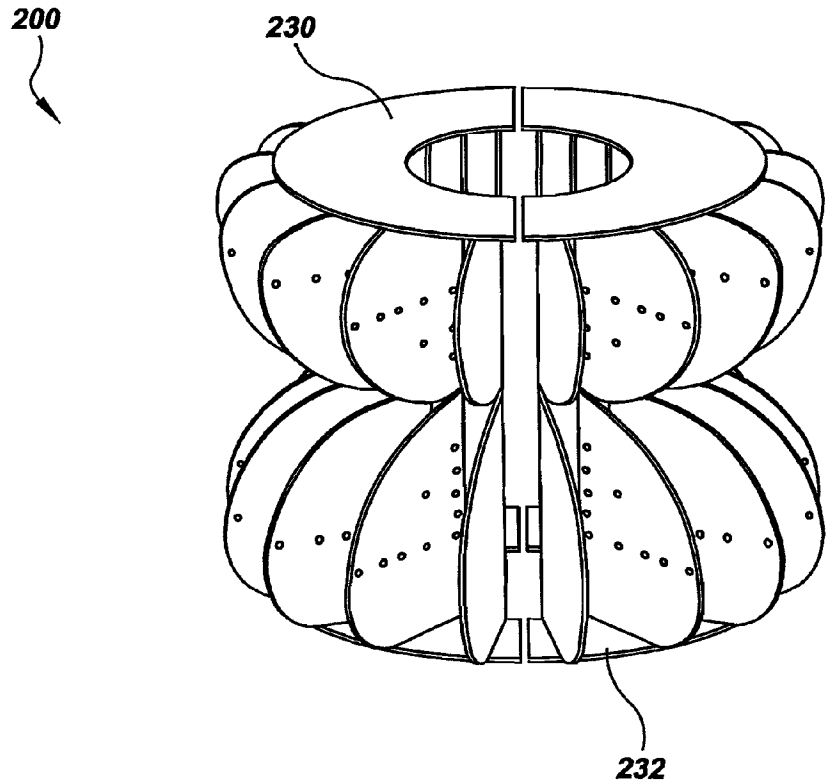
FIG. 2A is a perspective view of one embodiment of a TSAEC cylindrical array.

FIG. 2A is a perspective view of one embodiment of a TSAEC cylindrical array. EPCTSA 200 of FIG. 2A depicts a TSAEC cylindrical array having multiple TSA in a cylindrical configuration. As shown in FIG. 2A, TSAEC cylindrical array 200 comprises first end cap 230, second end cap 232 and sixteen TSA in a cylindrical configuration. First end cap 230 is electrically coupled to lateral edges of sixteen first antenna elements of the sixteen TSA in a manner similar to TSAEC apparatus 100 of FIG. 1A. Second end cap 232 is electrically coupled to lateral edges of sixteen second antenna elements of the sixteen TSA in a manner similar to TSAEC apparatus 100 of FIG. 1A.

Figure 2B:
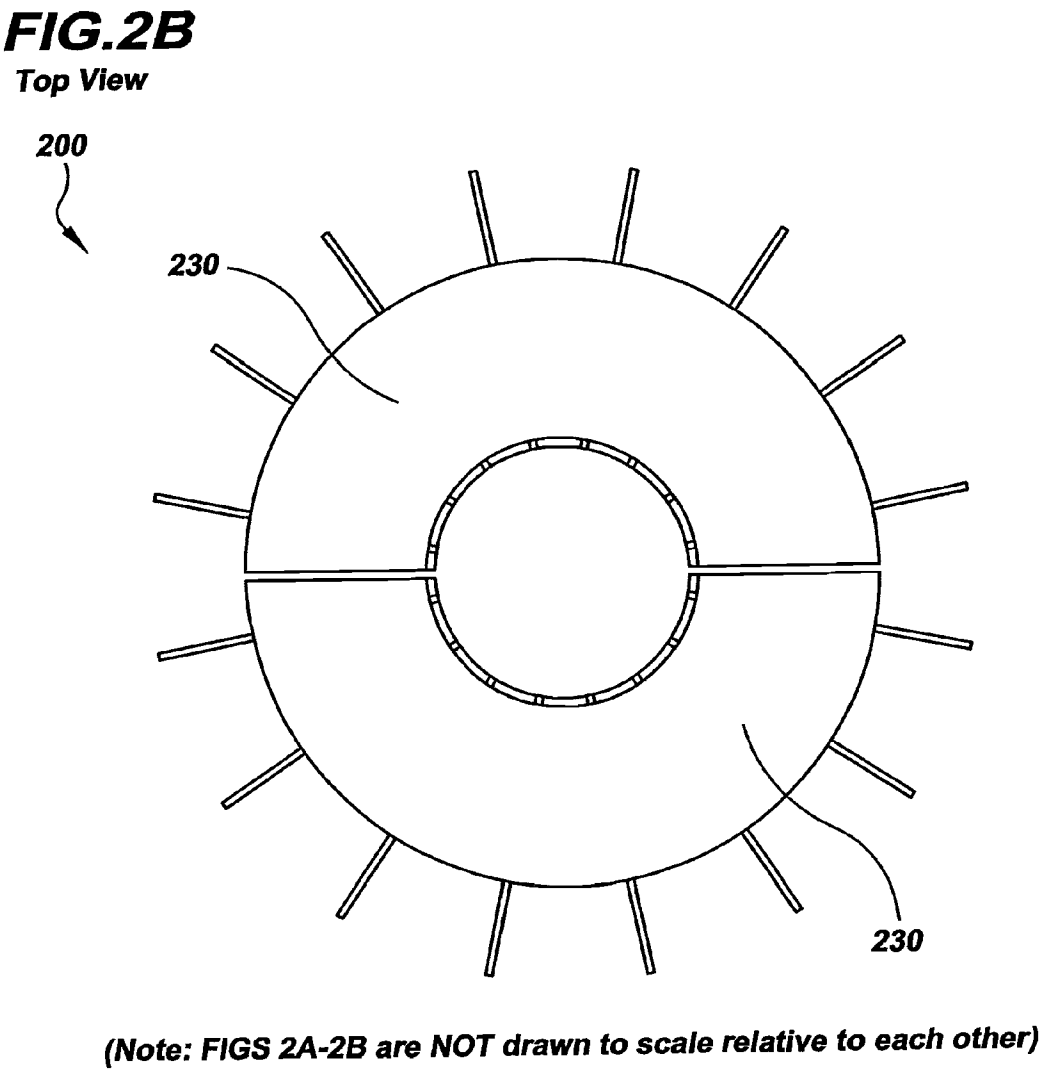
FIG. 2B is a top view of one embodiment of a TSAEC cylindrical array.

FIG. 2B is a top view of one embodiment of a TSAEC cylindrical array of FIG. 2A. TSAEC cylindrical array 200 of FIG. 2B is substantially similar to TSAEC cylindrical array 200 of FIG. 2A, and thus, similar components are not described again in detail hereinbelow.

Figure 3:
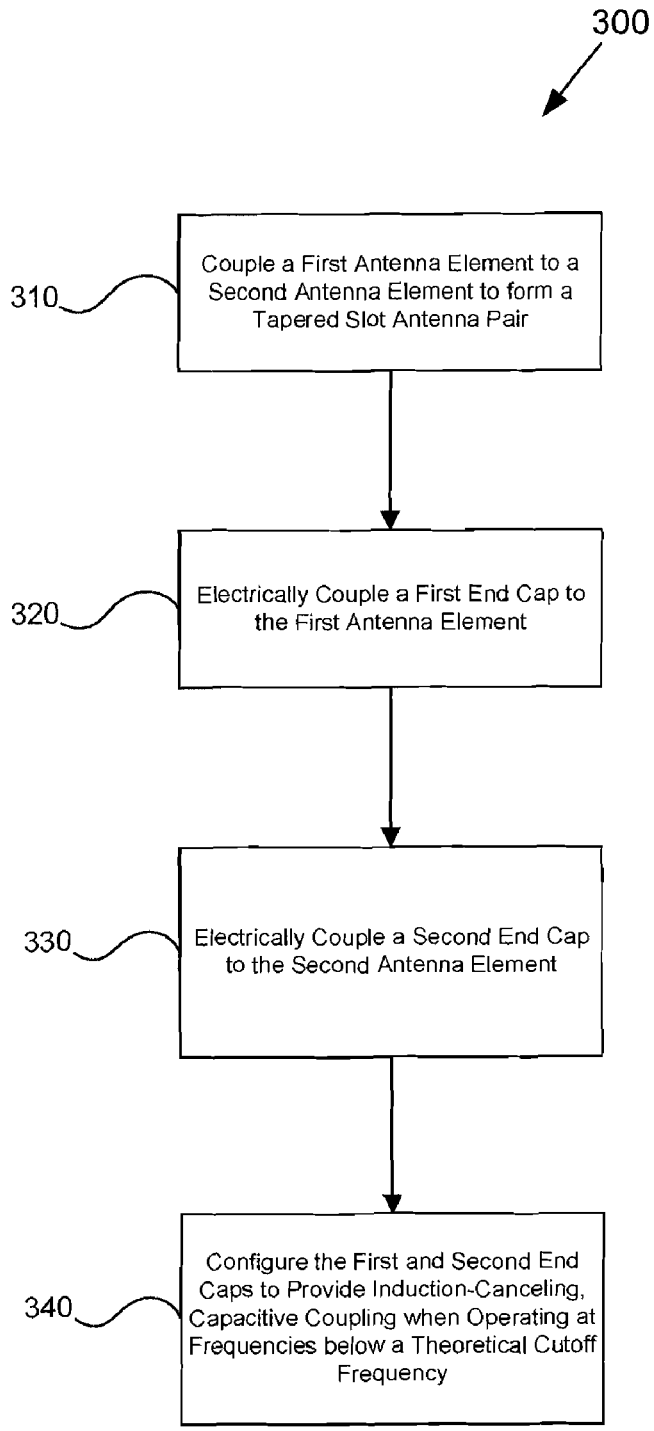
FIG. 3 is a flowchart illustrating exemplary process procedures taken to implement an embodiment of a TSAEC cylindrical array.

FIG. 3 is a flowchart illustrating exemplary process procedures taken to implement an embodiment of the invention. Certain details and features have been left out of flowchart 300 of FIG. 3 that are apparent to a person of ordinary skill in the art. For example, a procedure may consist of one or more sub-procedures or may involve specialized equipment or materials, as known in the art. While Procedures 310 through 340 shown in flowchart 300 are sufficient to describe one embodiment of the present invention, other embodiments of the invention may utilize procedures different from those shown in flowchart 300.

Referring to FIG. 3, at Procedure 310 in flowchart 300, the method couples a first antenna element to a second antenna element to form a tapered slot antenna pair. After Procedure 310, the method proceeds to Procedure 320. At Procedure 320 in flowchart 300, the method electrically couples a first end cap to the first antenna element. After Procedure 320, the method proceeds to Procedure 330. At Procedure 330 in flowchart 300, the method electrically couples a second end cap to the second antenna element. After Procedure 330, the method proceeds to Procedure 340. At Procedure 340 in flowchart 300, the method configures the first and second end caps to provide induction-canceling, capacitive coupling when operating at frequencies below a theoretical cutoff frequency. After Procedure 340, the method ends.

I claim:

1. A method, comprising:

coupling a first antenna element to a second antenna element to form a tapered slot antenna pair of the antenna elements, where the first and second antenna elements each have respective input edges, lateral edges and curvature edges and where the first and second antenna elements including the respective edges are spaced apart from one another by at least a gap height, and having feed ends along the respective input edges and launch ends along the respective curvature edges;

electrically coupling a first end cap to the first antenna element;

electrically coupling a second end cap to the second antenna element, the first and second end caps having an open plate configuration and electrically isolated from one another; and configuring the center lateral axis of the first and second end caps along the respective lateral edges only between the feed ends and launch ends so that the end caps extend equidistantly in a plane parallel to and extending over each side edge of the respective antenna elements to provide induction-canceling, capacitive coupling when operating at frequencies below a theoretical cutoff frequency, the open plate configuration creating the capacitive coupling.

2. The method of claim 1, wherein the electrical coupling of the first end cap to the first antenna element and the electrical coupling of the second end cap to the second antenna element provide the capacitive coupling when the antenna pair operates at frequencies lower than a predetermined lowest operating frequency.

3. The method of claim 1, further comprising optimizing a balance between capacitance generated by the end caps and inductance created when operating at frequencies below the lowest operating frequency.

4. A method, comprising:

coupling a first antenna element to a second antenna element to form a tapered slot antenna pair of the antenna elements, where the first and second antenna elements each have respective input edges, lateral edges and curvature edges and where the first and second antenna elements including the respective edges are spaced apart from one another by at least a gap height;

electrically coupling a first end cap to the first antenna element;

electrically coupling a second end cap to the second antenna element, the first and second end caps having an open plate configuration and electrically isolated from one another;

configuring the first and second end caps to provide induction-canceling, capacitive coupling when operating at frequencies below a theoretical cutoff frequency, the open plate configuration creating the capacitive coupling;

providing at least one of the first and second end caps with an interior region comprising a material different than the material comprising the end cap; and further comprising providing at least one of the first and second end caps with an interior region comprising a metal mesh.

* * * * *